US010553932B2

(12) United States Patent
Tsai et al.

(10) Patent No.: US 10,553,932 B2
(45) **Date of Patent: *Feb. 4, 2020**

(54) MOBILE DEVICE AND ANTENNA STRUCTURE

(71) Applicant: HTC Corporation, Taoyuan (TW)

(72) Inventors: Tiao-Hsing Tsai, Taoyuan (TW); Chien-Pin Chiu, Taoyuan (TW); Hsiao-Wei Wu, Taoyuan (TW); Ying-Chih Wang, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/432,748

(22) Filed: Jun. 5, 2019

(65) Prior Publication Data

US 2019/0288376 A1 Sep. 19, 2019

Related U.S. Application Data

(63) Continuation of application No. 15/943,067, filed on Apr. 2, 2018, now Pat. No. 10,355,341, which is a continuation of application No. 13/598,317, filed on Aug. 29, 2012, now Pat. No. 10,003,121.

(51) Int. Cl.

| | |
|---|---|
| ***H01Q 1/24*** | (2006.01) |
| ***H01Q 5/378*** | (2015.01) |
| ***H01Q 5/335*** | (2015.01) |
| ***H01Q 9/42*** | (2006.01) |

(52) U.S. Cl.

CPC ..... *H01Q 1/243* (2013.01); *H01Q 5/335* (2015.01); *H01Q 5/378* (2015.01); *H01Q 9/42* (2013.01)

(58) Field of Classification Search

CPC ..... H01Q 1/243; H01Q 5/335
USPC ..... 343/700 MS, 702
See application file for complete search history.

(56) References Cited

U.S. PATENT DOCUMENTS

| | | | |
|---|---|---|---|
| 6,515,629 | B1 | 2/2003 | Kuo et al. |
| 6,759,991 | B2 | 7/2004 | Boyle |
| 7,518,564 | B2 | 4/2009 | Guthrie |
| 9,166,300 | B2 | 10/2015 | Taura |
| 9,270,012 | B2 | 2/2016 | Nickel et al. |
| 10,003,121 | B2 | 6/2018 | Tsai et al. |
| 2001/0050637 | A1 | 12/2001 | Aoyama et al. |
| 2002/0135525 | A1 | 9/2002 | Ikegaya et al. |
| 2002/0140607 | A1 | 10/2002 | Zhou |
| 2003/0122721 | A1 | 7/2003 | Sievenpiper |

(Continued)

FOREIGN PATENT DOCUMENTS

| | | | |
|---|---|---|---|
| CN | 1377102 | A | 10/2002 |
| CN | 1412888 | A | 4/2003 |

(Continued)

*Primary Examiner* — Daniel Munoz
(74) *Attorney, Agent, or Firm* — Birch, Stewart, Kolasch & Birch, LLP

(57) ABSTRACT

A mobile device including a ground plane, a grounding branch, wherein a slot is formed between the ground plane and the grounding branch, a connecting element, wherein the grounding branch is electrically coupled through the connecting element to the ground plane and a feeding element, extending across the slot, and electrically coupled between the grounding branch and a signal source, wherein an antenna structure is formed by the grounding branch and the feeding element.

11 Claims, 6 Drawing Sheets

(56) References Cited

U.S. PATENT DOCUMENTS

| | | | |
|---|---|---|---|
| 2004/0246188 | A1 | 12/2004 | Egashira |
| 2004/0257283 | A1 | 12/2004 | Asano et al. |
| 2005/0007291 | A1 | 1/2005 | Fabrega-Sanchez et al. |
| 2005/0085204 | A1 | 4/2005 | Poilasne et al. |
| 2005/0200545 | A1* | 9/2005 | Bancroft ..... H01Q 13/10 343/770 |
| 2006/0197711 | A1 | 9/2006 | Sekiguchi et al. |
| 2007/0069957 | A1 | 3/2007 | Ranta |
| 2008/0042903 | A1 | 2/2008 | Cheng |
| 2009/0079647 | A1 | 3/2009 | Jung et al. |
| 2009/0121961 | A1 | 5/2009 | Sangawa |
| 2009/0153407 | A1 | 6/2009 | Zhang et al. |
| 2009/0167617 | A1 | 7/2009 | Nishio |
| 2010/0026596 | A1 | 2/2010 | Nishio et al. |
| 2010/0060531 | A1 | 3/2010 | Rappaport |
| 2010/0073247 | A1 | 3/2010 | Arkko et al. |
| 2010/0149052 | A1 | 6/2010 | Nishio et al. |
| 2010/0289708 | A1 | 11/2010 | Bungo et al. |
| 2010/0302106 | A1 | 12/2010 | Knudsen et al. |
| 2010/0316246 | A1 | 12/2010 | Cho et al. |
| 2011/0134011 | A1 | 6/2011 | Yamagajo |
| 2011/0136447 | A1 | 6/2011 | Pascolini et al. |
| 2012/0009983 | A1 | 1/2012 | Mow et al. |
| 2012/0214421 | A1 | 8/2012 | Hoirup et al. |
| 2012/0231750 | A1 | 9/2012 | Jin et al. |
| 2012/0280890 | A1 | 11/2012 | Kusumoto |

FOREIGN PATENT DOCUMENTS

| | | | |
|---|---|---|---|
| CN | 1745500 | A | 3/2006 |
| CN | 1778049 | A | 5/2006 |
| CN | 1926720 | A | 3/2007 |
| CN | 101002362 | A | 7/2007 |
| CN | 101488772 | A | 7/2009 |
| CN | 202025842 | U | 11/2011 |
| CN | 102377025 | A | 3/2012 |
| CN | 102394372 | A | 3/2012 |
| DE | 10 2008 050 743 | A1 | 4/2010 |
| EP | 0 613 209 | A1 | 8/1994 |
| EP | 0 869 579 | A1 | 10/1998 |
| EP | 1422787 | A1 | 5/2004 |
| EP | 1445823 | A1 | 8/2004 |
| EP | 1703586 | A1 | 9/2006 |
| EP | 2 405 534 | A1 | 1/2012 |
| EP | 2 434 652 | A1 | 3/2012 |
| TW | 200952252 | A | 12/2009 |
| TW | I335104 | | 8/2010 |
| TW | 201138205 | | 11/2011 |
| TW | 201216561 | A1 | 4/2012 |
| WO | WO 00/36475 | A2 | 6/2000 |
| WO | WO 03/003505 | A1 | 1/2003 |
| WO | WO 2005/062416 | A1 | 7/2005 |
| WO | WO 2006/030708 | A1 | 3/2006 |
| WO | WO 2008/012355 | A1 | 1/2008 |
| WO | WO 2009/027182 | A1 | 3/2009 |
| WO | WO 2010/040752 | A1 | 4/2010 |
| WO | WO 2011/073056 | A1 | 6/2011 |
| WO | WO 2011/086723 | A1 | 7/2011 |

* cited by examiner

MOBILE DEVICE AND ANTENNA STRUCTURE

CROSS-REFERENCE TO RELATED APPLICATIONS

This application is a Continuation of U.S. application Ser. No. 15/943,067 filed on Apr. 2, 2018, which is a Continuation of U.S. patent application Ser. No. 13/598,317 filed on Aug. 29, 2012, the entire contents of which are hereby expressly incorporated into the present application.

BACKGROUND OF THE INVENTION

The subject application generally relates to a mobile device, and more particularly, relates to a mobile device comprising an antenna structure.

With the progress of mobile communication technology, handheld devices, for example, portable computers, mobile phones, multimedia players, and other hybrid functional portable electronic devices, have become more common. To satisfy the demand of users, handheld devices usually can perform wireless communication functions. Some devices cover a large wireless communication area, for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

A mobile phone usually has a limited amount of inner space. However, more and more antennas should be arranged in the mobile phone to operate in different bands. The number of electronic components other than the antennas, in the mobile phone, has not been reduced. Accordingly, each antenna is close to the electronic components, negatively affecting the antenna efficiency and bandwidths thereof.

SUMMARY OF THE INVENTION

In one exemplary embodiment, the subject application is directed to a mobile device, comprising: a ground plane; a grounding branch, coupled to the ground plane, wherein a slot is formed between the ground plane and the grounding branch; and a feeding element, extending across the slot, and coupled between the grounding branch and a signal source, wherein an antenna structure is formed by the grounding branch and the feeding element.

BRIEF DESCRIPTION OF THE DRAWINGS

The subject application can be more fully understood by reading the subsequent detailed description and examples with references made to the accompanying drawings, wherein.

DETAILED DESCRIPTION OF THE INVENTION

Figure 1:
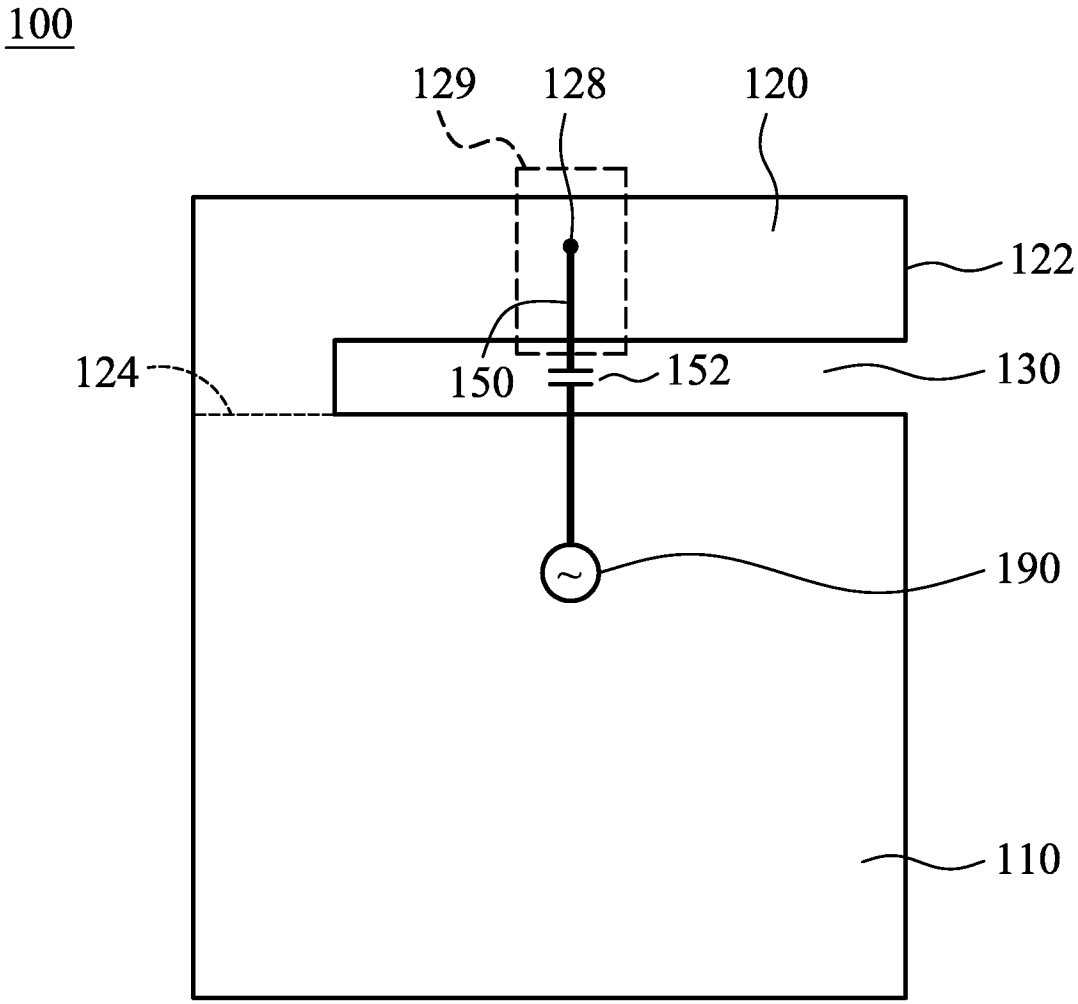
FIG. 1 is a diagram for illustrating a mobile device according to a first embodiment of the invention.

FIG. 1 is a diagram for illustrating a mobile device 100 according to a first embodiment of the invention. The mobile device 100 may be a cellular phone, a tablet computer, or a notebook computer. As shown in FIG. 1, the mobile device 100 at least comprises a ground plane 110, a grounding branch 120, and a feeding element 150. In some embodiments, the ground plane 110, the grounding branch 120, and the feeding element 150 are all made of conductive materials, such as silver, copper, or aluminum. The mobile device 100 may further comprise other essential components, for example, at least one housing, a touch input module, a display module, an RF (Radio Frequency) module, a processing module, a control module, and a power supply module (not shown).

The grounding branch 120 is coupled to the ground plane 110, wherein a slot 130 is formed between the ground plane 110 and the grounding branch 120. In the embodiment, the grounding branch 120 has an open end 122 and a grounding end 124, and the grounding end 124 is coupled to the ground plane 110. The grounding branch 120 may substantially have an L-shape. Note that the invention is not limited to the above. In other embodiments, the grounding branch 120 may have other shapes, such as a T-shape, an I-shape, or a U-shape.

The feeding element 150 extends across the slot 130, and is coupled between the grounding branch 120 and a signal source 190. In some embodiments, the feeding element 150 and the ground plane 110 are disposed on different planes. An antenna structure is formed by the grounding branch 120 and the feeding element 150. The feeding element 150 may further comprise a capacitor 152, which is coupled between a feeding point 128 located on the grounding branch 120 and the signal source 190. In a preferred embodiment, the capacitor 152 has a smaller capacitance and provides higher input impedance. The capacitor 152 may be a general capacitor or a variable capacitor. By adjusting the capacitance of the capacitor 152, the antenna structure may be excited to generate one or more operation bands. The capacitor 152 may substantially lie on the slot 130 (as shown in FIG. 1), or be substantially located on the grounding branch 120.

More particularly, the feeding element 150 is coupled to the feeding point 128 located on the grounding branch 120, wherein the feeding point 128 is away from the grounding end 124 of the grounding branch 120. It is understood that in a traditional PIFA (Planar Inverted-F Antenna), a feeding point is usually very close to a grounding end. In some embodiments, the feeding point 128 is substantially located on a middle region 129 of the grounding branch 120. When a user holds the mobile device 100, a palm and a head of the user is close to the edges of the ground plane 110 and the grounding branch 120. Therefore, if the feeding point 128 is located on the middle region 129 of the grounding branch 120, the antenna structure will be not influenced by the user so much. In a preferred embodiment, except for the feeding element 150 and the capacitor 152, there is no conductive component (e.g., metal traces and copper foils) extending across the slot 130 and its vertical projection plane.

Figure 2:
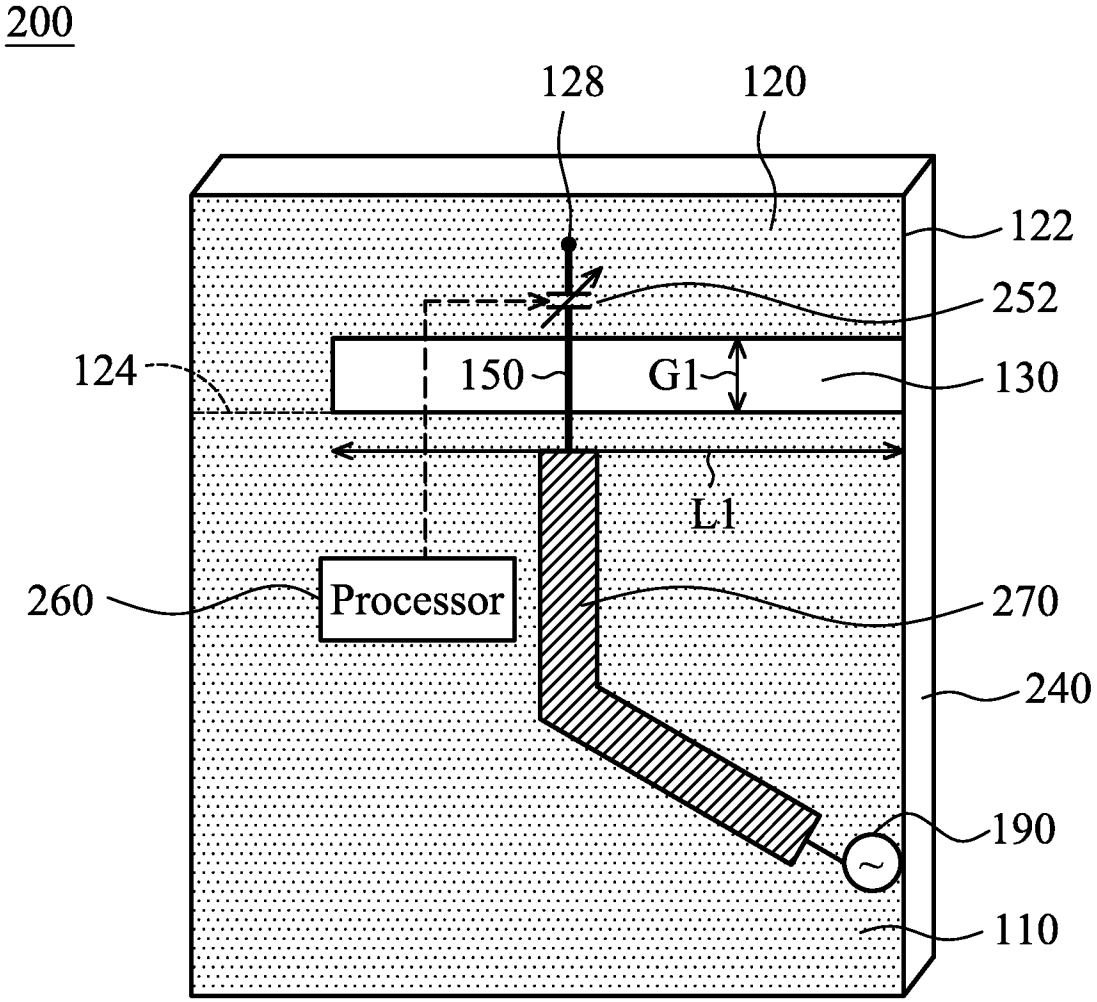
FIG. 2 is a diagram for illustrating a mobile device according to a second embodiment of the invention.

FIG. 2 is a diagram for illustrating a mobile device 200 according to a second embodiment of the invention. In comparison to FIG. 1, the mobile device 200 further comprises a dielectric substrate 240, a processor 260, and/or a coaxial cable 270. The dielectric substrate 240 may be an FR4 substrate or a hard and flexible composite substrate. The ground plane 110 and the grounding branch 120 are both disposed on the dielectric substrate 240. In the embodiment, the feeding element 150 comprises a variable capacitor 252. Similarly, the variable capacitor 252 may substantially lie on the slot 130, or be substantially located on the grounding branch 120 (as shown in FIG. 2). The processor 260 can adjust a capacitance of the variable capacitor 252. In some embodiments, the processor 260 adjusts the capacitance of the variable capacitor 252 according to an operation state of the mobile device in such a manner that the antenna structure of the mobile device 200 can operate in different bands. In addition, the coaxial cable 270 is coupled between the feeding element 150 and the signal source 190. As described above in FIG. 1, except for the feeding element 150 and the capacitor 152, there is no conductive component (e.g., metal traces and copper foils) extending across the slot 130 and its vertical projection plane. In some embodiments, the slot 130 is either formed through the dielectric substrate 240 or not formed through the dielectric substrate 240. If there is no other conductive component disposed in the slot 130 and its vertical projection plane, the antenna structure can have good antenna efficiency and bandwidth.

Figures 3A, 3B, 3C:
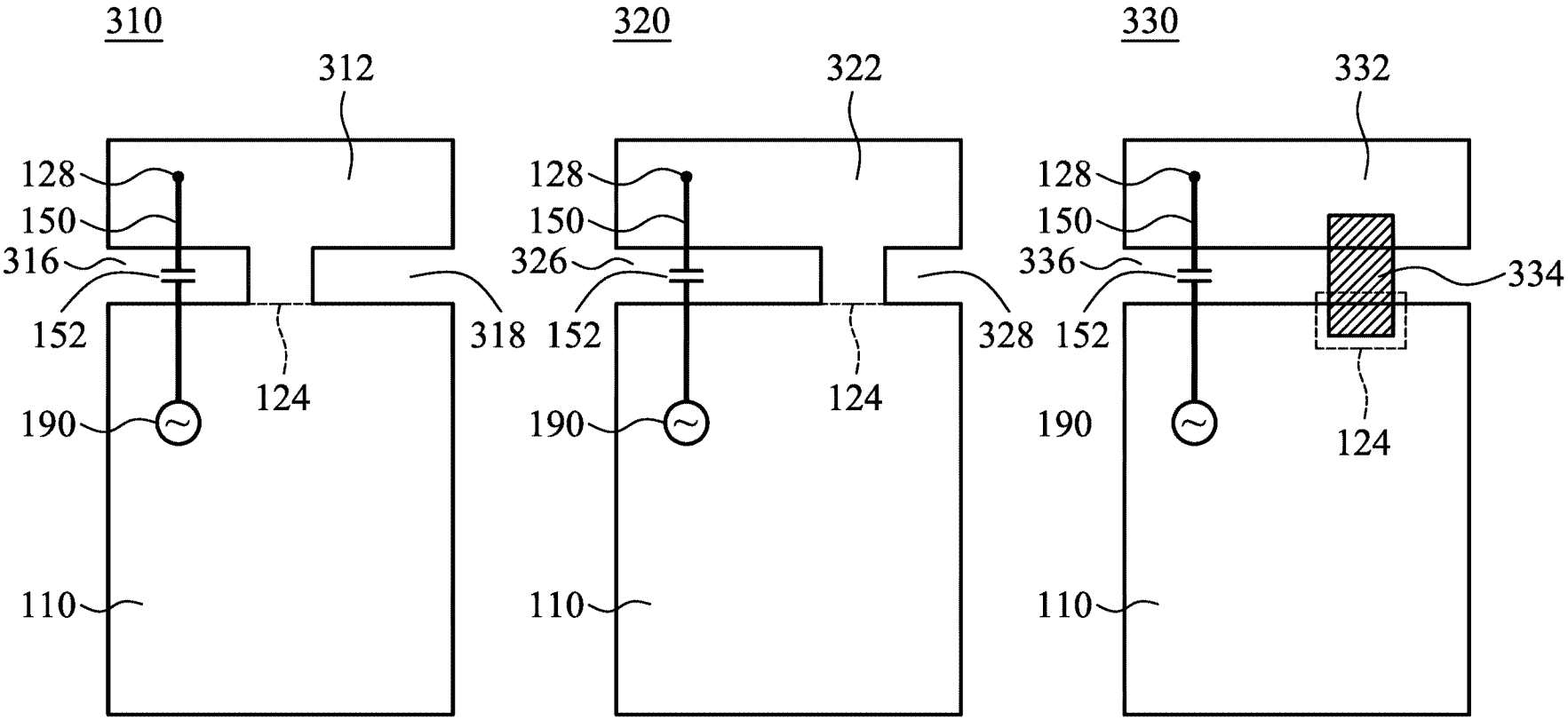
FIG. 3A is a diagram for illustrating a mobile device according to a third embodiment of the invention.
FIG. 3B is a diagram for illustrating a mobile device according to a fourth embodiment of the invention.
FIG. 3C is a diagram for illustrating a mobile device according to a fifth embodiment of the invention.

FIG. 3A is a diagram for illustrating a mobile device 310 according to a third embodiment of the invention. The mobile device 310 in the third embodiment is similar to the mobile device 100 in the first embodiment. The difference between the two embodiments is that the two slots 316 and 318 are formed between the ground plane 110 and a grounding branch 312 in the mobile device 310, wherein the grounding branch 312 substantially has a T-shape. The slot 316 is substantially separated from the slot 318. The feeding element 150 may extend across one of the slots 316 and 318 to excite an antenna structure of the mobile device 310. In the embodiment, the slots 316 and 318 are substantially aligned in a same straight line, and the length of the slot 316 is substantially equal to the length of the slot 318.

FIG. 3B is a diagram for illustrating a mobile device 320 according to a fourth embodiment of the invention. The mobile device 320 in the fourth embodiment is similar to the mobile device 100 in the first embodiment. The difference between the two embodiments is that the two slots 326 and 328 are formed between the ground plane 110 and a grounding branch 322 in the mobile device 320, wherein the grounding branch 322 substantially has a T-shape. The slot 326 is substantially separated from the slot 328. The feeding element 150 may extend across one of the slots 326 and 328 to excite an antenna structure of the mobile device 320. In the embodiment, the slots 326 and 328 are substantially alinged in a same straight line, and the length of the slot 326 is greater than the length of the slot 328. In other embodiments, the length of the slot 326 is changed to be smaller than the length of the slot 328.

FIG. 3C is a diagram for illustrating a mobile device 330 according to a fifth embodiment of the invention. The mobile device 330 in the fifth embodiment is similar to the mobile device 100 in the first embodiment. The difference between the two embodiments is that the mobile device 330 further comprises an FPCB (flexible printed circuit board) 334, and a slot 336 separates the ground plane 110 from a grounding branch 332 completely, wherein the grounding branch 332 substantially has an I-shape. The feeding element 150 may extend across the slot 336 to excite an antenna structure of the mobile device 330. In the embodiment, since the grounding branch 332 is coupled through the FPCB 334 to a grounding end 124 of the ground plane 110, thus the FPCB 334 may be considered as a portion of the antenna structure. Therefore, the FPCB 334 does not influence the radiation performance of the antenna structure very much.

Figure 4:
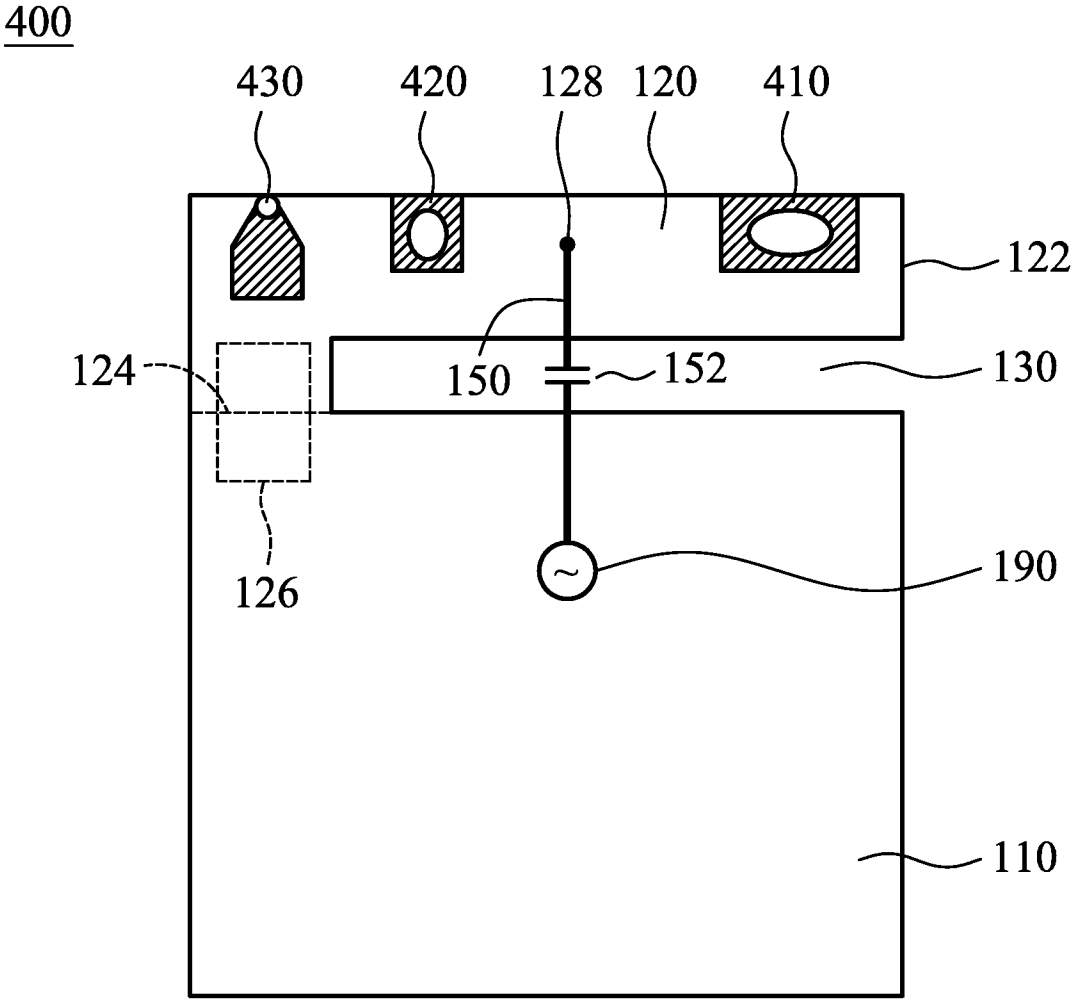
FIG. 4 is a diagram for illustrating a mobile device according to a sixth embodiment of the invention.

FIG. 4 is a diagram for illustrating a mobile device 400 according to a sixth embodiment of the invention. The mobile device 400 in the sixth embodiment is similar to the mobile device 100 in the first embodiment. The difference between the two embodiments is that the mobile device 400 further comprises one or more electronic components, for example, a speaker 410, a camera 420, and/or a headphone jack 430. The one or more electronic components are disposed on the grounding branch 120 of an antenna structure of the mobile device 400, and may be considered as a portion of the antenna structure. Accordingly, the one or more electronic components do not influence the radiation performance of the antenna structure very much. In the embodiment, the antenna region may load the one or more electronic components and may be integrated therewith, appropriately, thereby saving use of the inner design space of the mobile device 400. Note that the one or more electronic components would all be coupled through a wiring region 126 to a processing module and a control module (not shown).

Figure 5:
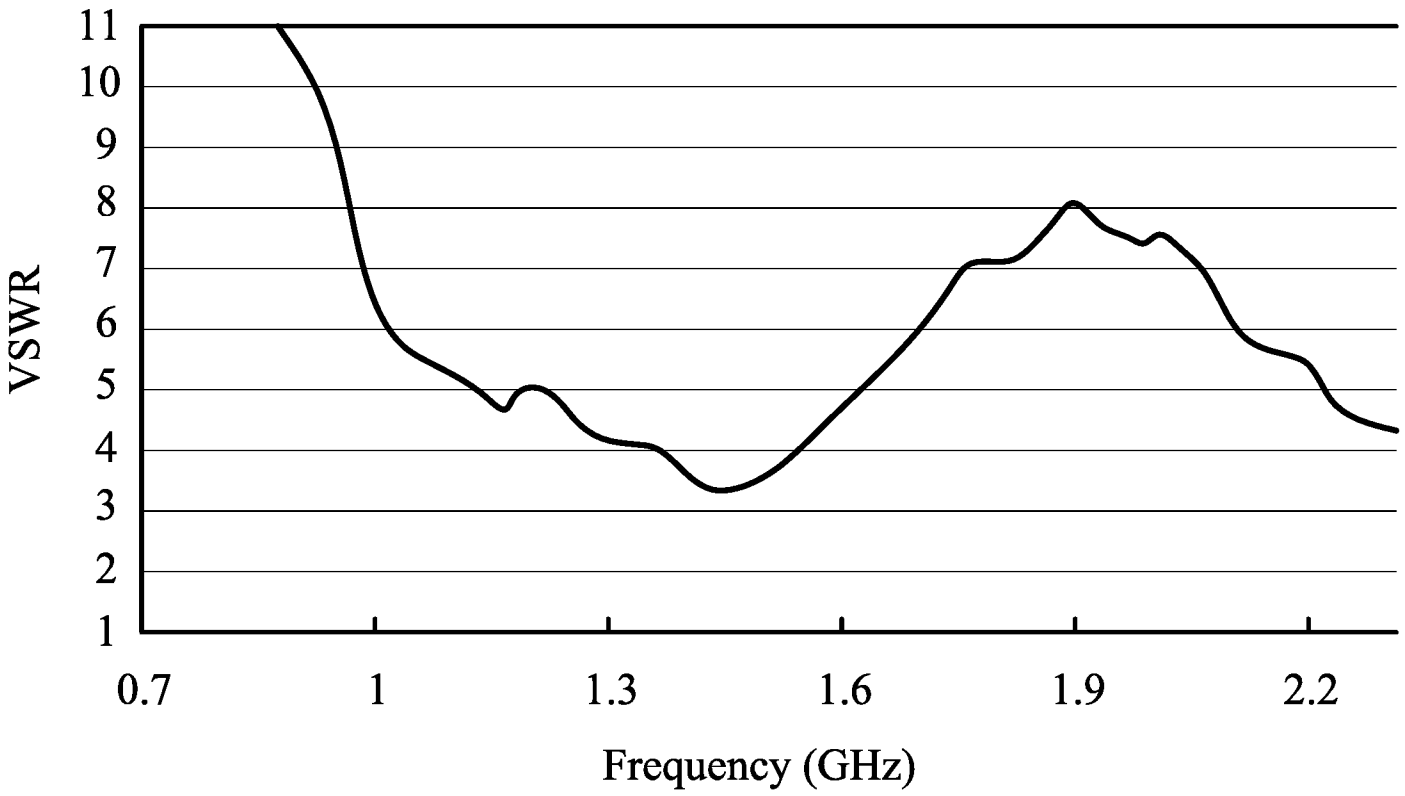
FIG. 5 is a diagram for illustrating a VSWR (Voltage Standing Wave Ratio) of a mobile device without any variable capacitors according to the second embodiment of the invention.

FIG. 5 is a diagram for illustrating a VSWR (Voltage Standing Wave Ratio) of the mobile device 200 without the variable capacitor 252 according to the second embodiment of the invention. The horizontal axis represents operation frequency (GHz), and the vertical axis represents the VSWR. As shown in FIG. 5, when the variable capacitor 252 is removed from the mobile device 200, the antenna structure of the mobile device 200 merely covers a single band, and the band cannot be adjusted easily.

Figure 6:
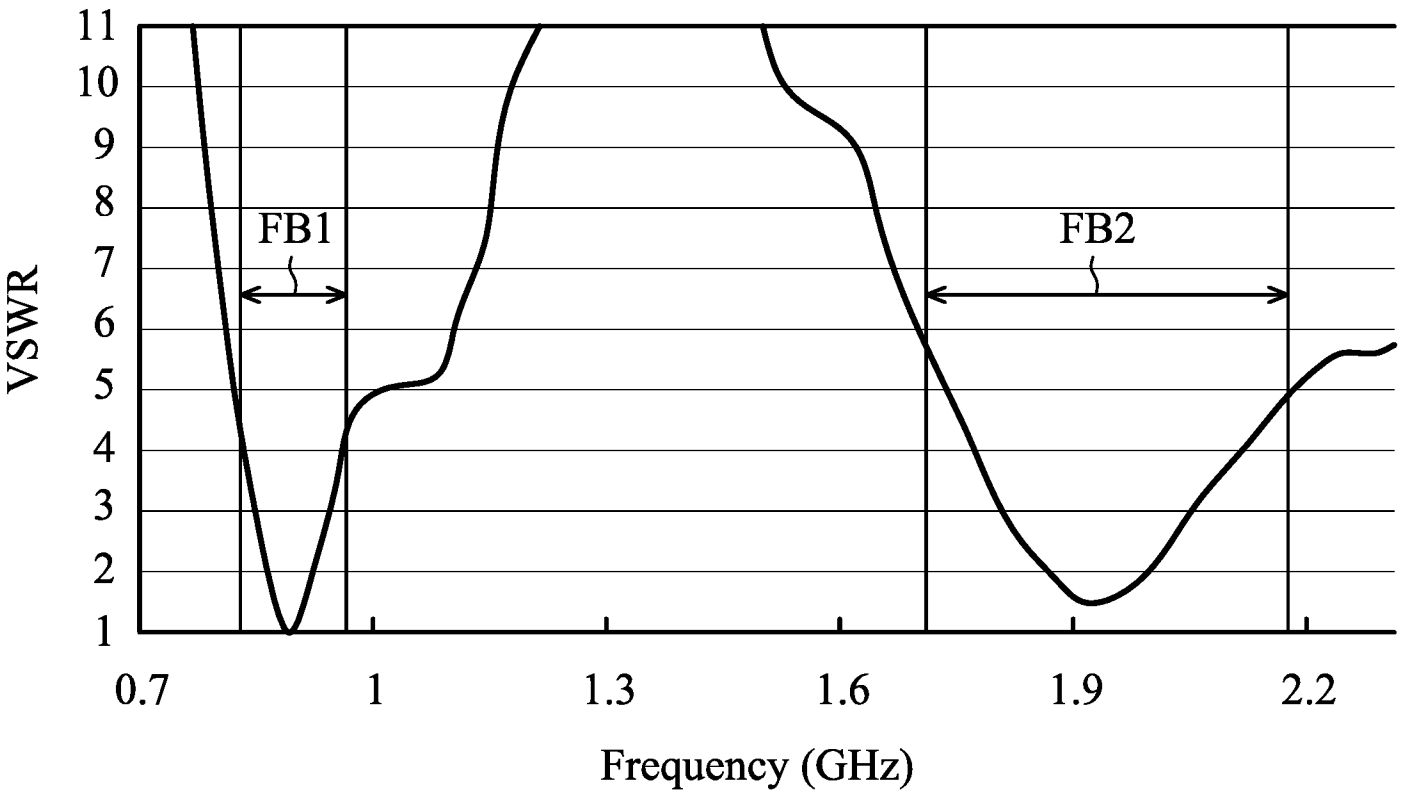
FIG. 6 is a diagram for illustrating a VSWR of a mobile device with a variable capacitor according to the second embodiment of the invention.

FIG. 6 is a diagram for illustrating a VSWR of the mobile device 200 with the variable capacitor 252 according to the second embodiment of the invention. The horizontal axis represents operation frequency (GHz), and the vertical axis represents the VSWR. As shown in FIG. 6, when the antenna structure of the mobile device 200 is fed through the feeding element 150 comprising the variable capacitor 252, the antenna structure is excited to generate a first band FB1 and a second band FB2. In a preferred embodiment, the first band FB1 is approximately from 824 MHz to 960 MHz, and the second band FB2 is approximately from 1710 MHz to 2170 MHz. By adjusting the capacitance of the variable capacitor 252, the antenna structure can cover multiple bands and control the frequency ranges of the bands easily.

Refer back to FIG. 2. Theoretically, the antenna structure of the mobile device 200 mainly has two resonant paths. A first resonant path is from the grounding end 124 of the grounding branch 120 through the feeding point 128 to the open end 122 of the grounding branch 120. A second resonant path is from the feeding point 128 to the open end 122 of the grounding branch 120. In some embodiments, the longer first resonant path is excited to generate the lower first band FB1, and the shorter second resonant path is excited to generate the higher second band FB2. The frequency range of the first band FB1 is controlled by changing the capacitance of the variable capacitor 252 and by changing the length L1 of the slot 130. The frequency range of the second band FB2 is controlled by changing the distance between the feeding point 128 and the grounding end 124. The bandwidth between the first band FB1 and the second band FB2 is controlled by changing the width G1 of the slot 130. For the low band, since the feeding point 128 is away from the grounding end 124 of the grounding branch 120, the total impedance of the antenna structure rises. When the capacitor 152 with a small capacitance is coupled to the feeding element 150, a feeding structure with higher impedance is formed. The small capacitance does not influence the high band much such that the antenna structure can maintain resonant modes in the high band to generate multiple bands. On the contrary, when another capacitor with a large capacitance is coupled to the feeding element 150, the resonant modes of the antenna structure in the low band are influenced such that the antenna structure cannot operate in specific multiple bands.

In an embodiment, the element sizes and the element parameters are as follows. The length of the ground plane 110 is approximately equal to 108 mm. The width of the ground plane 110 is approximately equal to 60 mm. The thickness of the dielectric substrate 240 is approximately equal to 0.8 mm. The length L1 of the slot 130 is approximately from 45 mm to 57 mm. The width G1 of the slot 130 is approximately from 0.6 mm to 2.5 mm. The largest capacitance of the variable capacitor 252 is about three times that of the smallest capacitance thereof. For example, the capacitance of the variable capacitor 252 is approximately from 0.5 pF to 1.5 pF, or is approximately from 0.9 pF to 2.7 pF. In other embodiments, the variable capacitor 252 may be replaced with a general capacitor. After the measurement, the antenna efficiency of the antenna structure is greater than 49.7% in the first band FB1, and is greater than 35.3% in the second band FB2.

Note that the invention is not limited to the above. The above element sizes, element parameters and frequency ranges may be adjusted by a designer according to different desires. The mobile devices and the antenna structures therein, for all of the embodiments of the invention, have similar performances after being finely tuned, because they have been designed in similar ways.

In the invention, the antenna structure of the mobile device is fed through the capacitor with high impedance, and thus, the antenna structure can operate in multiple bands. Since the feeding point of the antenna structure is away from the grounding end of the ground plane, the antenna structure can maintain good radiation performance even if a user is close to the antenna structure. In addition, the antenna structure may be used to load some electronic components, thereby saving use of the inner design space of the mobile device.

The embodiments of the disclosure are considered as exemplary only, not limitations. It will be apparent to those skilled in the art that various modifications and variations can be made in the invention. The true scope of the disclosed embodiments being indicated by the following claims and their equivalents.

What is claimed is:

1. A mobile device, comprising:

a ground plane;

a grounding branch, coupled to the ground plane, wherein a slot is formed between the grounding branch and the ground plane, wherein the grounding branch has an open end and a grounding end, and the grounding end is coupled to the ground plane;

a feeding element, coupled between a first feeding point and a signal source, wherein the first feeding point is disposed above the slot; and wherein the slot is a first slot, and a second slot is further formed between the ground plane and the grounding branch, and the first slot is separated from the second slot, and wherein each of the first slot and the second slot has a closed end and an open end, and wherein the open end of the first slot and the open end of the second slot extend toward opposite directions.

2. The mobile device as claimed in claim 1, wherein the feeding element extending across the whole width of the slot.

3. The mobile device as claimed in claim 1, wherein the grounding branch substantially has an L-shape.

4. The mobile device as claimed in claim 1, wherein the grounding branch substantially has an I-shape.

5. The mobile device as claimed in claim 1, wherein the feeding element is coupled to the first feeding point located on the grounding branch.

6. The mobile device as claimed in claim 1, wherein an antenna structure is formed by the grounding branch and the feeding element.

7. The mobile device as claimed in claim 1, further comprising:

a dielectric substrate, wherein the antenna structure is disposed on the dielectric substrate.

8. The mobile device as claimed in claim 7, wherein the slot is not formed through the dielectric substrate.

9. The mobile device as claimed in claim 1, wherein the two slots are separated by the grounding end of the grounding branch.

10. The mobile device as claimed in claim 6, wherein the antenna structure is excited to generate a first band and a second band, and the first band is approximately from 824 MHz to 960 MHz, and the second band is approximately from 1710 MHz to 2170 MHz.

11. The mobile device as claimed in claim 1, wherein the mobile device further comprises one or more electronic components disposed above the slot.

* * * * *